US008702868B2

(12) United States Patent
Gassen et al.

(10) Patent No.: US 8,702,868 B2
(45) Date of Patent: Apr. 22, 2014

(54) METHOD FOR DECONTAMINATING SURFACES OF NUCLEAR PLANTS WHICH HAVE BEEN CONTAMINATED WITH ALPHA EMITTERS

(75) Inventors: Rainer Gassen, Fürth (DE); Christoph Stiepani, Fürth (DE); Horst-Otto Bertholdt, Forchheim (DE); Bertram Zeiler, Bischberg (DE)

(73) Assignee: Areva GmbH, Erlangen (DE)

( * ) Notice: Subject to any disclaimer, the term of this patent is extended or adjusted under 35 U.S.C. 154(b) by 441 days.

(21) Appl. No.: 12/472,695

(22) Filed: May 27, 2009

(65) Prior Publication Data

US 2010/0116288 A1 May 13, 2010

Related U.S. Application Data

(63) Continuation of application No. PCT/EP2008/059289, filed on Jul. 16, 2008.

(30) Foreign Application Priority Data

Aug. 17, 2007 (DE) ..... 10 2007 038 947

(51) Int. Cl.
*C23G 1/02* (2006.01)

(52) U.S. Cl.
USPC ..... 134/3; 134/2; 134/34; 134/41

(58) Field of Classification Search
None
See application file for complete search history.

(56) References Cited

U.S. PATENT DOCUMENTS

| | | | | |
|---|---|---|---|---|
| 4,729,855 | A | 3/1988 | Murray et al. | |
| 4,756,768 | A | 7/1988 | Bertholdt et al. | |
| 5,306,444 | A * | 4/1994 | Kitamura et al. | 510/490 |
| 5,752,206 | A | 5/1998 | Frink et al. | |
| 5,958,247 | A | 9/1999 | Bertholdt et al. | |
| 6,028,113 | A * | 2/2000 | Scepanski | 514/643 |
| 2003/0172959 | A1 | 9/2003 | Martin | |
| 2006/0211592 | A1 | 9/2006 | Faure et al. | |

FOREIGN PATENT DOCUMENTS

| | | | |
|---|---|---|---|
| EP | 0 160 831 | B1 | 12/1991 |
| EP | 0 753 196 | B1 | 9/1998 |
| JP | 09159798 | A | 6/1997 |
| JP | 2007198736 | A | 8/2007 |
| WO | 0204707 | A1 | 1/2002 |

OTHER PUBLICATIONS

EPO machine translation of EP 0160831 retrieved Jul. 22, 2010.*
International Search Report, dated Feb. 13, 2009.

* cited by examiner

*Primary Examiner* — Eric Golightly
(74) *Attorney, Agent, or Firm* — Laurence A. Greenberg; Werner H. Stemer; Ralph E. Locher

(57) ABSTRACT

A method for decontaminating nuclear plant surfaces, which have been contaminated with alpha emitters, is carried out subsequently to a decontamination process which is aimed at the removal of oxide layers. The surfaces are treated with an aqueous solution which contains a cationic or zwitterionic surfactant and oxalic acid. At least a part of the solution, after having acted on a surface, is conducted across an ion exchanger.

10 Claims, No Drawings

METHOD FOR DECONTAMINATING SURFACES OF NUCLEAR PLANTS WHICH HAVE BEEN CONTAMINATED WITH ALPHA EMITTERS

CROSS-REFERENCE TO RELATED APPLICATION

This is a continuation, under 35 U.S.C. §120, of copending International Application No. PCT/EP2008/059289, filed Jul. 16, 2008, which designated the United States; this application also claims the priority, under 35 U.S.C. §119, of German Patent Application DE 10 2007 038 947.9, filed Aug. 17, 2007; the prior applications are herewith incorporated by reference in their entirety.

BACKGROUND OF THE INVENTION

Field of the Invention

The invention relates to methods for decontaminating surfaces which have been contaminated with alpha emitters in nuclear plants, e.g. for decontaminating surfaces of components of a coolant system of nuclear power plants, which will be referred to below, by way of example.

Radioactive oxide layers, which are formed during power plant operation on inner surfaces of components of the coolant system, for example pipelines, pumps, steam generator tubes, need to be removed when dismantling a shut-down nuclear power plant in order to reduce the radioactive emission of the components to tolerable values.

The oxide layer on component surfaces is removed, for example, by a two-stage decontamination method in which the oxide layer is pretreated in a first stage with a strong oxidizing agent such as potassium permanganate or permanganic acid, and the oxide layer is dissolved in a second stage with a cleaning solution containing one or more sequestering acids. The used cleaning solution containing the constituents of the oxide layer in dissolved form is either concentrated to a residue by evaporation or fed through ion exchangers in order to remove the oxide layer's constituents present in ionic form from the cleaning solution. Spent ion exchange material and the cleaning solution residue remaining after concentration by evaporation are sent in a suitable form to temporary or final storage.

European Patent EP 0 753 196 B1, corresponding to U.S. Pat. No. 5,958,247, discloses a method for disposing of an aqueous cleaning solution which has previously been used to remove ferritic deposits. The cleaning solution includes an organic acid plus the ferritic deposits dissolved in the form of iron complexes. The disclosed method makes it possible to convert the total organic acid into $CO_2$ and water with the aid of a cycle process. After the cycle process has been carried out, only a relatively small amount of iron salt remains in the solution, and that can be removed with the aid of a cation exchanger. Since the cycle process requires the presence of iron ions in the cleaning solution, they are added to the cleaning solution at the start unless they are already present at a sufficient concentration due to the preceding decontamination.

U.S. Pat. No. 4,729,855 discloses a similar cleaning method, in which the internal surfaces of a nuclear reactor are initially oxidized and subsequently treated with the aid of a cleaning solution containing acid. The radioactive metal ions thereby enter into solution and are subsequently removed from the cleaning solution with the aid of an ion exchanger.

Such decontamination, or comparable decontamination carried out in the course of routine repair work on the coolant system, basically removes only gamma nuclides such as Cr-51 and Co-60. Those nuclides are for the most part present in the form of their oxides, for example incorporated in an oxide layer of a component, which are dissolved relatively easily by the active substances of conventional decontamination solutions, for example sequestering acids. Transuranics such as Am-241 are also partially dissolved.

However, oxide particles invisible to the naked eye, which contain alpha emitters or to which alpha emitters are bound, also remain on the surfaces decontaminated, i.e. freed, from oxide layers by one of the aforementioned cleaning methods. Those particles only loosely adhere to the surface of components having an oxide layer which has already been removed, so that the alpha emitters can partially be wiped off with a cloth, for example in the course of a wipe test. Besides those particles, particles including gamma emitters may also be present on a component surface.

When dismantling a nuclear engineering plant, the components of the coolant system should be sent for recycling, which is only possible when the radioactivity measured on a component lies below predetermined limit values with respect to gamma and beta radiation, as well as with respect to alpha radiation.

U.S. Patent Application Publication No. 2003/0172959 A1 discloses a surface decontamination method. The cleaning solution proposed for that purpose contains a surfactant as a wetting agent plus a keto-amine as an active cleaning component. The cleaning solution may additionally be provided with an acid, for example oxalic acid. After the cleaning treatment has been carried out, the used cleaning solution is discharged and collected in a suitable container. The used cleaning solution is then available for a generally conventional disposal method (not specified in detail), for example concentration by evaporation.

SUMMARY OF THE INVENTION

It is accordingly an object of the invention to provide a method for decontaminating surfaces of nuclear plants which have been contaminated with alpha emitters, which overcomes the hereinafore-mentioned disadvantages of the heretofore-known methods of this general type and which can simply and effectively remove alpha emitters present on surfaces of nuclear plants, for example on components of the coolant system of nuclear power plants, in particular with the aim of minimizing the amount of residual radioactive waste.

With the foregoing and other objects in view there is provided, in accordance with the invention, a method for decontaminating nuclear plant surfaces having been contaminated with alpha emitters, after carrying out a decontamination method in which oxide layers present on the surfaces have been at least partially removed. The method comprises treating the surfaces with an aqueous solution containing oxalic acid and a zwitterionic and/or cationic surfactant, using an amino acid of a general formula HOOC—R—$NH_2$ and an N-oxide of a general formula R1-(NO)(R2)(R3) with an aliphatic radical R1 having from 4 to 24 C atoms and aliphatic radicals R2, R3 each having from 1 to 10 C atoms as the zwitterionic surfactant, using a primary amine of a general formula R—$NH_2$ as the cationic surfactant, and feeding at least some of the solution through an ion exchanger after it has acted on the surface.

After extensive tests had been carried out unsuccessfully with a wide variety of substances, it was very surprising that particles with alpha activity adhering to surfaces could be removed by a treatment according to the invention. The particles may be formed of the oxide of an alpha emitter. They may also be other particles, to the surface of which alpha emitters adhere.

The components of a nuclear plant which are formed, for example, of stainless steel or a nickel-based alloy, for example components of the coolant system, then do not need to be disposed of expensively but instead can be reused. The amount of nuclides emitting alpha rays (referred to below as alpha nuclides for short) can thereby be reduced so much that the surfaces have an activity of less than 0.1 $Bq/cm^2$. By reducing the alpha activity, values which usually lie significantly above a limit value of 10 are achieved for the ratio of gamma to alpha decay values. When this limit value for the components is detected, only measurements of the gamma radiation are necessary in order to approve them for reprocessing, for example, and this can be done with simple instruments and little time expenditure. If a limit value of 10 cannot be detected, time-consuming and technologically elaborate measurements of the alpha radiation must be carried out, and the personnel must be monitored in a time-intensive and cost-intensive way through the use of excretion analyses for the absorption of alpha nuclides.

Through the use of this treatment, the relevant particles adhering to a component surface are transferred into solution, and the gamma activity present on the surface is furthermore reduced.

In accordance with another mode of the invention, in order to reduce the volume, the aqueous solution is fed through a cation exchanger before it is optimally subjected to a further treatment, for example concentrated by evaporation, or reused. Very surprisingly, it has been found that the alpha activity bound to the surfactant is transferred to the ion exchanger. Due to this measure, the residual waste remaining at the end of the cleaning, which needs to be sent in a suitable form to final or temporary storage, can be reduced to a very small amount. The oxalic acid remains in solution and can be removed, for example by the method of according to European Patent EP 0 753 196 B1, corresponding to U.S. Pat. No. 5,958,247.

The reason why the combination of oxalic acid and a surfactant causes the particles to be dissolved from a component surface is not known. It was also surprising that both when using cationic and zwitterionic surfactants, the particles containing alpha nuclides become bound to cation exchange resins and can therefore be removed easily from the solution.

The method according to the invention will be carried out after a widely known decontamination method intended for the removal of oxide layers. It is particularly advantageous when oxalic acid has already been used in that method. The addition of oxalic acid is thereby obviated, or at least is required only to a smaller extent. In order to remove the particles which have been dissolved from the oxide layers and which in this case primarily include metal ions, at least some of the solution is fed through an ion exchanger, preferably through a cation exchanger.

In accordance with a further mode of the invention, the oxalic acid solution which is suitable in each case depends inter alia on the nature and the thickness of the oxide layers to be removed, but in any event should be at least 250 ppm. The upper limit of the oxalic acid concentration is 15,000 ppm. Contents in excess of this provide scarcely any further significant effect.

A surfactant which is particularly suitable for carrying out the method according to the invention must, on one hand, be effective in combination with oxalic acid with a view toward dissolving particles from surfaces. On the other hand, it must facilitate binding of the particles to a cation exchanger so that they can be removed at least partially from the solution.

In accordance with an added mode of the invention, this is the case with primary amines of the general formula R—$NH_2$ with an aliphatic radical of from 8 to 24 C atoms. In this case, hexadecyl amine is to be highlighted as being particularly suitable. Among zwitterionic surfactants, amino acids of the general formula HOOC—R—$NH_2$ with an aliphatic radical of from 4 to 24 C atoms and N-oxides of the general formula R1-(NO)(R2)(R3) have proven suitable, in the latter case having as aliphatic radicals R1 with from 4 to 24 C atoms and R2, R3 each with from 1 to 10 C atoms. N-oxides in which R1 includes from 12 to 24 C atoms and R2/R3 include from 1 to 3 C atoms, are particularly preferred. Among this group of surfactants, dimethyl octadecyl amine N-oxide has been found to be the surfactant which acts best.

In accordance with an additional mode of the invention, in all cases, treatment at an elevated temperature of more than 30° C. is expedient. With a view to the efficiency and duration of the treatment, a temperature of at least 50° C. is preferred, with the upper limit being 200° C.

In accordance with a concomitant mode of the invention, the concentration of the surfactant respectively used depends inter alia on its chemical structure and the effectiveness resulting therefrom, as well as on the nature and thickness of the oxide deposits. A concentration range which covers a wide application spectrum lies between 50 ppm and 3,000 ppm.

Other features which are considered as characteristic for the invention are set forth in the appended claims.

Although the invention is described herein as embodied in a method for decontaminating surfaces of nuclear plants which have been contaminated with alpha emitters, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying examples.

DETAILED DESCRIPTION OF THE INVENTION

In order to study the effectiveness of individual surfactants, tests were carried out with original samples from different systems, for example tubes of the primary circuit and of steam generators. The surfaces were coated with an oxide layer, formed during the power plant operation and having incorporated or adhering activity. In order to remove the oxide layer, it was initially treated oxidatively according to European Patent EP 0 160 831 B1, corresponding to U.S. Pat. No. 4,756,768, and subsequently dissolved from the sample surfaces with the aid of a decontamination solution containing oxalic acid. Surfaces treated in that way or a comparable way appear metallically blank when observed with the naked eye. However, invisible particles adhere to them, above all the afore-mentioned particles including alpha nuclides.

In order to remove them, the samples were put into a container of an aqueous solution containing a surfactant at a concentration of at least 150 ppm, 350 ppm or 2,000 ppm and oxalic acid at a concentration of more than 50 ppm. The samples were treated for between 5 and 40 hours at an elevated temperature of from 50° C. to 200° C.

The effect of the steps carried out was checked by observing two typical representatives of the nuclides present in total on the surface, namely americium-241 (alpha emitter) and cobalt-60 (gamma emitter). Americium was selected because it can be determined by relatively simple measures through gamma radiation which accompanies its alpha decay. Measurements were respectively carried out in the untreated state (an oxide layer formed during power plant operation is present), after dissolving the oxide layer and after treatment with a solution containing a surfactant and oxalic acid, and the respective ratios of the gamma activity to the alpha activity were calculated.

The result of the test carried out with hexadecyl amine (A) as a cationic surfactant and dimethyl octadecyl amine N-oxide (B) as a zwitterionic surfactant may be seen in Table 1 below. The decontamination factors achieved in the tests are given in Table 2.

TABLE 1

| Test | Surfactant | ppm (mg/l) | Nuclide | Untreated [Bq/cm$^2$] | After dissolving Ox. layer [Bq/cm$^2$] | After treatment with surfactant/oxalic acid (10,000 ppm) [Bq/cm$^2$] |
|---|---|---|---|---|---|---|
| 1 | A | 350 | Co-60 | 4.4E+05 | 3.4E+00 | 9.8E−01 |
| | | | Am-241 | 4.1E+03 | 4.4E+00 | 2.4E−03 |
| | | | ratio | 106 | 8 | 408 |
| 2 | A | 150 | Co-60 | 6.5E+06 | 1.5E+04 | 6.4E+03 |
| | | | Am-241 | 3.3E+03 | 8.5E+0 | 6.2E−01 |
| | | | ratio | 2,000 | 1760 | 10,330 |
| 3 | B | 2,000 | Co-60 | 4.1E+04 | 2.5E+02 | 8.5E+01 |
| | | | Am-241 | 1.9E+02 | 2.3E+00 | 8.1E−02 |
| | | | ratio | 215 | 109 | 1,050 |

TABLE 2

| | After H2C2O4 DF | After ALPHA DF |
|---|---|---|
| Co-60 | 50-1,000 | 300-90,000 |
| Am-241 | 50-1,000 | 1,000-350,000 |

With conventional oxide dissolving, a ratio of gamma to alpha activity (Co-60/Am-241) is often found which is less than the corresponding ratio on the as yet untreated components, or their surfaces, i.e. the relative proportion of alpha emitters has increased. If, however, the method according to the invention is used (in the case of the tests in question it was carried out after conventional oxide dissolving) a majority of the alpha nuclides present on the component surface is removed, which is reflected in the gamma/alpha ratio. This increased by a factor of about 500 in Test 1, a factor of about 6 in Test 2 and a factor of about 10 in Test 3. The conventional treatment leads to metallically blank surfaces which, however, frequently have an intolerable residual activity that could not be reduced further by known chemical methods. Through the use of a subsequent surfactant treatment of the proposed type, the residual activities or the decontamination factors (DF) can be drastically reduced, specifically by from 6 to 90 times in the case of Co-60 and from 20 to 350 times in the case of Am-241.

A solution with activity, dissolved from the sample surface, was brought in contact with a cation exchange resin and subsequently filtered mechanically, and then the percentage distribution of the activity between the exchange resin, the filtrate and the filter residue was determined. As a result, it was found that about 95% of the Co-60 and 100% of the Am-241 were bound to the cation exchange resin. The majority of the activity can thereby be removed from the solution and bound to the cation exchange resin. The latter may be sent to the conventional disposal route.

The remaining solution may be reprocessed by breaking down the oxalic acid which it contains under the effect of UV radiation, and subsequently sent for further cleaning over a fixed bed. The solution may then be reused or concentrated by evaporation for the purpose of final storage.

The invention claimed is:

1. A method for decontaminating nuclear plant surfaces having been contaminated with alpha emitters, the method comprising the following steps:

performing a decontamination in which oxide layers present on said surfaces have been at least partially removed:

treating said surfaces with an aqueous solution containing oxalic acid and a surfactant having a zwitterionic surfactant selected from an amino acid of a general formula HOOC—R—$NH_2$ where R is any organic substituent, or an N-oxide of a general formula R1-(NO)(R2)(R3) with an aliphatic radical R1 having from 4 to 24 C atoms and aliphatic radicals R2 and R3 each having from 1 to 10 C atoms; and feeding at least some of said solution through an ion exchanger after it has acted on said surfaces.

2. The method according to claim 1, which further comprises providing said ion exchanger as a cation exchanger.

3. The method according to claim 1, which further comprises providing said oxalic acid in a concentration of from 250 ppm to 15,000 mg/l.

4. The method according to claim 1, wherein said partial removal of said oxide layer present on the surface is removed with a cleaning solution containing oxalic acid.

5. The method according to claim 1, wherein the aqueous solution further contains a cationic surfactant, the cationic surfactant being a primary amine of a general formula R4-$NH_2$ where R4 is an aliphatic radical including from 8 to 24 C atoms.

6. The method according to claim 1, wherein said amino acid has an aliphatic radical R including from 4 to 24 C atoms.

7. The method according to claim 5, wherein said amine is dimethyl amine octadecyl N-oxide.

8. The method according to claim 1, which further comprises carrying out the method with a surfactant concentration of from 50 ppm to 5,000 mg/l.

9. The method according to claim 1, which further comprises carrying out the method at a temperature of from 30° C. to 100° C.

10. The method according to claim 1, which further comprises providing the radical R1 of the N-oxide with from 12 to 24 C atoms and providing each of the radicals R2 and R3 of the N-oxide with from 1-3 C atoms.

* * * * *